US011885585B2

(12) United States Patent
Caudle et al.

(10) Patent No.: US 11,885,585 B2
(45) Date of Patent: Jan. 30, 2024

(54) NOISE REDUCTION DEVICE FOR AIR GUN

(71) Applicants: Carl E Caudle, Moses Lake, WA (US); Nathanel J Caudle, Moses Lake, WA (US)

(72) Inventors: Carl E Caudle, Moses Lake, WA (US); Nathanel J Caudle, Moses Lake, WA (US)

(73) Assignee: MODERN PNEUMATIC SPORTING DEVICES, Dalton Gardens, ID (US)

( * ) Notice: Subject to any disclaimer, the term of this patent is extended or adjusted under 35 U.S.C. 154(b) by 99 days.

(21) Appl. No.: 17/667,744

(22) Filed: Feb. 9, 2022

(65) Prior Publication Data

US 2022/0268549 A1 Aug. 25, 2022

Related U.S. Application Data

(60) Provisional application No. 63/151,598, filed on Feb. 19, 2021.

(51) Int. Cl.
*F41A 21/30* (2006.01)
*F41B 11/70* (2013.01)

(52) U.S. Cl.
CPC ..... *F41B 11/70* (2013.01); *F41A 21/30* (2013.01)

(58) Field of Classification Search
CPC ..... F41B 11/70; F41A 21/30; F41A 21/04; F41A 21/36
USPC ..... 124/1, 3
See application file for complete search history.

(56) References Cited

U.S. PATENT DOCUMENTS

| | | | | |
|---|---|---|---|---|
| 2,765,706 | A * | 10/1956 | Strohl | F41A 21/36 89/14.3 |
| 9,377,263 | B1 * | 6/2016 | Sy | F41A 21/325 |
| 10,739,097 | B1 * | 8/2020 | Gaines | F41A 21/30 |
| 11,435,156 | B1 * | 9/2022 | Dellinger | G10K 11/165 |
| 11,493,297 | B2 * | 11/2022 | Wilson | B23K 35/3033 |
| 2019/0017768 | A1 * | 1/2019 | Thomas | F41A 21/30 |
| 2019/0257607 | A1 * | 8/2019 | Dobrinescu | F41A 21/30 |
| 2019/0353447 | A1 * | 11/2019 | Palenik, II | F41A 21/36 |
| 2020/0096279 | A1 * | 3/2020 | Hibbitts | F41A 21/30 |
| 2021/0190450 | A1 * | 6/2021 | Buchel | F41A 21/30 |
| 2021/0254920 | A1 * | 8/2021 | Miller | F41A 21/30 |
| 2021/0381791 | A1 * | 12/2021 | Magee | F41A 21/30 |
| 2022/0163281 | A1 * | 5/2022 | Madigan | F41A 21/30 |

* cited by examiner

*Primary Examiner* — John E Simms, Jr.

(57) ABSTRACT

A noise reduction device designed for use with air rifles and sub-sonic applications is disclosed. The noise reduction device includes a plurality of collinear rings, each having a plurality of filaments fixed thereto in a radial configuration, so as to define an opening at the center of each of the rings.

19 Claims, 6 Drawing Sheets

NOISE REDUCTION DEVICE FOR AIR GUN

PRIORITY CLAIM AND CROSS-REFERENCE TO RELATED APPLICATION

This application claims the benefit under 35 U.S.C. § 119(e)(1) of U.S. Provisional Application No. 63/151,598, filed Feb. 19, 2021, which is hereby incorporated by reference in its entirety.

BACKGROUND

An air gun is a type of gun that launches projectiles pneumatically with compressed air or other compressed gases (air is already a mixture of various gases). Such "non-firearm" guns can come in several varieties, such as pump air guns, $CO_2$ cartridge air guns, and PCP (Pre-Charged Pneumatics) air guns, which utilize a reservoir or "tank" of compressed air or gases. A PCP air gun may be an unregulated mechanical PCP, a regulated mechanical PCP, or an electronic PCP.

A conventional firearm, by contrast, generates pressurized combustion gases chemically through exothermic oxidation of combustible propellants, such as gunpowder, which generate propulsive energy by breaking molecular bonds in an explosive production of high temperature gases. In modern firearms, the combustion gases are generally formed within a cartridge comprising the projectile inserted into a casing containing the fuel. This propulsive energy is used to launch the projectile from the casing, and thus from the firearm.

Other differences between air guns and conventional firearms can be observed as differences in pressures inside the respective barrels, muzzle energies, projectile speeds, and projectiles that can be shot, for example. A conventional rifle chambered for a .22 long rifle (LR) cartridge fires a 40-grain bullet at approximately 1200 ft/sec. A powerful air rifle may fire a 14.3 grain pellet with a muzzle velocity of approximately 900 ft/sec. The conventional firearm generates a muzzle energy of approximately 130 ft-lbs of energy at the muzzle whereas that of the air rifle generates only about 26 ft-lbs.

The compressed gas of air guns currently has a reservoir or tank with maximum pressures of 4500-5000 psi, but these high pressures are not currently in common use. On the other hand, by comparison, the lowest pressure rifle cartridges may be black powder cartridges of yesteryear and certain rimfire cartridges. Some of these lesser firearm cartridges still generate barrel pressures of 15,000-20,000 psi, or 20,000-25,000 psi for rimfire, which is a much higher magnitude of pressure than air guns can currently achieve.

Therefore, the conventional high power air rifle is still "handicapped" in comparison to conventional firearms by low operating pressure of ⅕ that of a firearm, or lower, which is its primary limitation when being compared with firearms. This limitation can restrict the type and size of projectile that an air gun can launch, based on the mass of the projectile and the limited available energy of the air gun.

Nevertheless, an air gun can make a noise that is loud and potentially damaging to the ears of nearby individuals when triggered.

BRIEF DESCRIPTION OF THE DRAWINGS

The detailed description is set forth with reference to the accompanying figures. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1A:
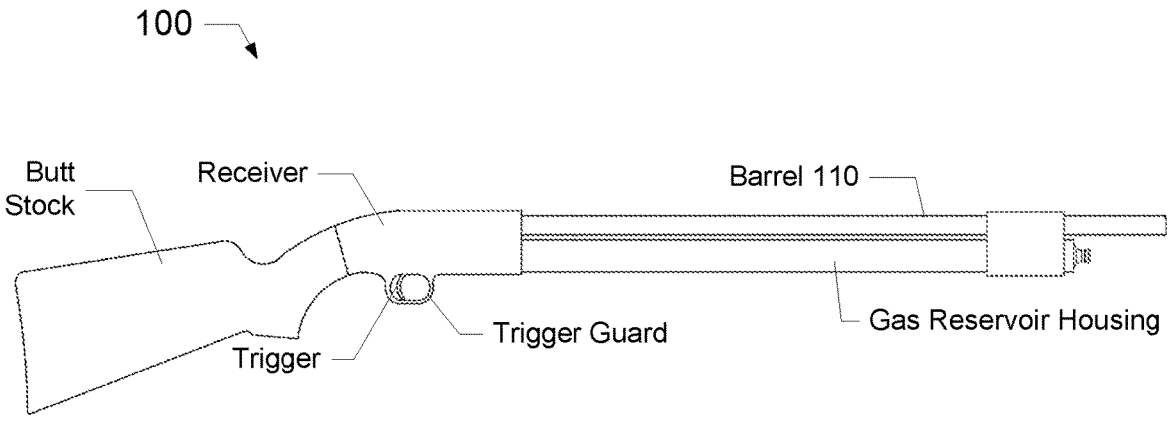
FIG. 1A shows a right side view of an example air rifle.
Figure 1B:
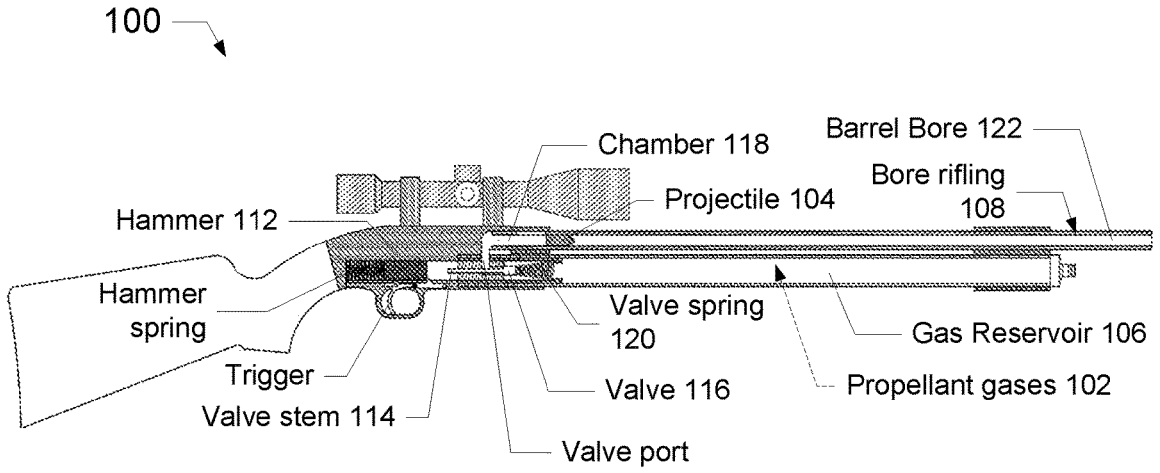
FIG. 1B shows a right side view of a section view of an air rifle, showing interior details.

Referring to FIGS. 1A and 1B, the operation of a typical air gun 100 is described. The one or more propellant gases 102 of an air gun 100 go from high pressure to a lower pressure when propelling a projectile 104, but the one or more gases 102 remain the same gases chemically. Significantly, the magnitude of pressure in the reservoir 106 or gas source of an air gun 100 before a projectile 104 is shot by the air gun 100 (which can be upwards of 6000 psi in some cases) represents the maximum pressure that can be achieved behind a projectile 104 in a conventional air gun 100, because there is no explosive combustion of gunpowder to create additional pressure (no expanding gases). Accordingly, the pressure curve for a conventional air gun 100 is characterized by diminishing gas pressure and low or no heat, which provide the energy for propelling a projectile 104 from the air gun 100. The initial lower pressures of air guns 100 and the diminishing pressure characteristic result in lower forces, which result in limited projectile 104 accelerations.

For example, it takes a large amount of energy to push a projectile 104 into the rifling 108 of a rifle barrel 110, since the rifling 108 often has an overall diameter that is slightly less than the outer diameter of the projectile 104. Much of the available energy from the high-pressure gas 102 may be used to push the projectile 104 into the rifling 108, deforming it to fit the rifling 108, and thus diminishing the total energy available to generate a desired velocity for the projectile 104.

When the air gun 100 is triggered, the hammer 112 strikes the valve stem 114, opening the valve 116 and quickly releasing some of the pressurized gases 102 from the reservoir 106 into the chamber 118 behind the projectile 104. The pressure within the chamber 118 rises as stored compressed gases 102 are introduced into the chamber 118. Pressure within the chamber 118 quickly builds to match the gas pressure of the compressed gas reservoir 106 (which may be onboard or remote from the air gun 110). Projectile 104 acceleration starts at zero as the compressed gas 102 enters the chamber 118 of the air gun 100 until there is enough breech pressure for the projectile 104 to move. The valve spring 120 and the pressure within the reservoir 106 combine to quickly reseat the reservoir valve 116, stopping the release of gas 102 from the reservoir 106.

The projectile 104 is expelled from the barrel 110 of the air gun 100 if sufficient pressure is present behind the projectile 104. The pressure of the gases 102 within the chamber 118 and within the barrel 110 behind the projectile 104 diminishes as the projectile 104 travels down the bore 122 of the barrel 110, since the volume the gas 102 occupies increases. As the projectile 104 moves down the length of the barrel 110, the compressed gas 102 expands to fill the additional volume inside the barrel 110 and the void created by the projectile 104 moving down the barrel bore 122. The available energy to perform the work of driving a projectile 104 diminishes as the gas 102 expands, thus reducing the force on the projectile 104 as it travels down the barrel 110. With the increase of volume, the gas 102 cools as it loses energy and pressure, finally dropping to ambient pressure as the projectile 104 leaves the end of the barrel 110.

Generally, only a portion of the pressurized gas 102 stored in the gas reservoir 106 is released into the firing chamber 118 when the air rifle 100 is triggered. As the amount of compressed gas 102 passes into the chamber 118 and barrel 110 of the air rifle 100, the volume of gas 102 in the reservoir tank 106 is decreased and the gas pressure within the reservoir 106 also decreases. Accordingly, less pressure and less energy is available for subsequent triggering events. After a number of shots, the gas reservoir 106 no longer has sufficient gas pressure (e.g., stored energy) for additional shots, until it is recharged to full pressure.

While the sound from an air gun 100 may not be as loud as the sound from a similarly sized firearm, an air gun 100 can make a noise that is loud and potentially damaging to the ears of nearby individuals when triggered. Accordingly, air gun users and close bystanders are encouraged to wear sufficient ear protection. Health and safety laws, regulations, guidelines, and recommendations (for instance from The Occupational Safety and Health Administration of the United States Department of Labor (OSHA), The National Institute for Occupational Safety and Health (NIOSH), The Centers for Disease Control and Prevention (CDC), and others) are promulgated to provide information regarding the health hazards, including risks of hearing loss, related to exposure to noise hazards. Exposure to loud noises, including while participating in recreational activities, can have serious effects on a person's health and well-being. For example, hearing loss due to inner ear damage can often be permanent. Accordingly, there are also noise ordinances enacted in various localities to protect the hearing and health of the residents.

One reason an air gun 100 may be loud when triggered is that the compressed air 102 quickly leaving the gun 100 can make a loud sound, with higher pressure guns 100 often making a louder noise. The triggering mechanism can be analogous to a pressure release valve on a high pressure air tank. Another reason is related to the velocity of the projectile 104 as it leaves the barrel 110. If the projectile 104 is super-sonic, meaning it travels faster than the speed of sound (approximately 1125 fps, depending on temperature and altitude), that can cause a shock wave or a mini sonic boom. These and other factors can add up to sounds in the 70's (about as loud as a vacuum cleaner) to 110's (about as loud as a night club band) of decibels for some air guns 100. For perspective, the human pain threshold is about 120 decibels.

The disclosure herein describes techniques and devices for reducing the noise from an air gun 100 when triggered. The techniques and devices discussed are particular to air guns 100, and designs are based on the unique characteristics of air guns 100 relative to firearms. Accordingly, a noise reduction device 200 that is effective for an air gun 100 may not be equally effective for a firearm, and vice versa. However, the noise reduction device 200 disclosed herein may be formed using selected alternative materials for use with firearms, if desired, and can be effective in substantially reducing the noise produced by a triggered firearm. In other words, the design of some embodiments of the noise reduction device 200 may be similar for air guns 100 and firearms, while the materials used can be significantly different, since different values of pressure and heat are encountered in the various cases.

Most states in the U.S. allow the use of silencers on firearms for hunting purposes. Silencers allow these hunters some advantage in the hunt, since they can make it difficult for the prey animal to determine the direction of the shot's origin, as well as provide significant protection against hearing damage. Further, the weight of silencers on the end of the barrel can reduce muzzle lifting due to recoil. The disclosed noise reduction device allows the air gun enthusiast to also participate in hunting activities, enjoying some of the same benefits without incurring health risks, and without being a nuisance to others in the area.

Representative implementations of devices and techniques provide a noise reduction device 200 (hereinafter "NRD 200") for an air gun 100. The NRD 200 is coupled to or integral to the muzzle end of the barrel 110 of an air gun 100 to reduce the intensity or loudness of the noise of a shot report. The NRD 200 is specifically structured and designed for use with air guns 100, and to be effective when used with an air gun 100, and may not be compatible with combustion-type firearms, unless formed of materials capable of high temperatures and pressures. In many embodiments, the heat generated by a firearm can be destructive to the NRD 200 as disclosed herein.

In one example, a plurality of filaments 202 are coupled to portions of the coils 204 of a helix-like component 206, such as a spring, or the like. In some embodiments, a pressure stabilization region 502 is added, which may resemble an outer tube surrounding the filaments 202 and coils 204. Further, air apertures 602 can be added to any of the described embodiments to further reduce the loudness of the shot. Any of the disclosed devices and techniques may be used in any combination with an air rifle 100 to reduce the intensity of the noise of a triggering event.

EXAMPLE EMBODIMENTS: NOISE REDUCTION DEVICE (NRD) FOR AIR GUNS

Embodiments of noise reduction devices 200 (NRDs) are disclosed herein, in various embodiments. The NRDs 200 are intended for use with air guns 100, and may be integral to or coupled to the barrel 110 of an air gun 100. For instance, an NRD 200 may be attached to the end of an air gun barrel 110 (e.g., in various conventional or unique ways) or the air gun barrel 110 may be formed with the NRD 200 as an integral portion of the barrel 110.

As discussed above, the energy source for an air gun 100 is a fixed amount of compressed gas 102 that, when released into the barrel bore 122, diminishes in efficiency as it pushes the projectile 104 out. Since the compressed gas 102 does not burn and is not the result of burning fuel, it is not an expanding gas. Reducing the noise level of an air gun 100 can be related to redirecting the available energy (or residual energy) of the shot. One way to redirect the energy includes redirecting the air flow, which can include slowing the velocity of the pressurized gas 102 before releasing it into the atmosphere. Example techniques are explained in the embodiments below.

The embodiments of NRD 200 disclosed herein can be made from any material suitable for the purpose, including ferrous and non-ferrous metals, composites, and all forms of emerging fiber engineering technologies, such as carbon fiber and all of its variations, as well as various polymers and plastics. Further, the filaments 202 described herein can be made of Teflon, plastics, carbon fibers, metals, and so forth.

The embodiments of NRD 200 disclosed herein can be manufactured through conventional methods (stamping, molding, casting, extruding, etc.) and notably with emerging technologies. For example, the NRD 200 or any of the components disclosed for the NRD 200 may be 3D printed or otherwise formed of composites, polymers, glasses, ceramics, and the like. The NRD 200 can be attached to a prior art gun barrel 110 by any common means (threaded, bayonet connection, friction fit, twist-lock, etc.) or built into the end of an air gun barrel 110 (integral to the barrel 110).

Figure 2A:
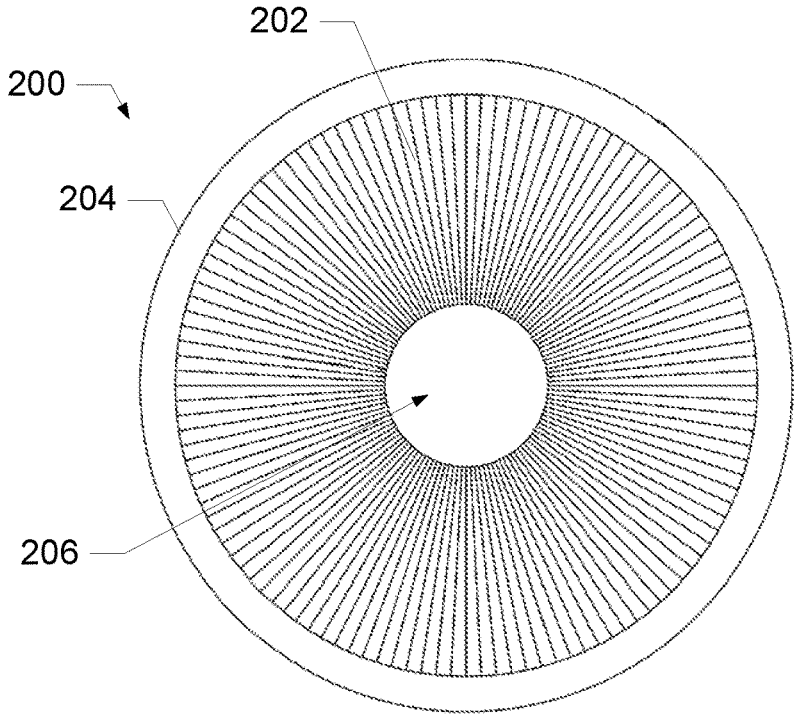
FIGS. 2A and 2B show a front view of an example noise reduction device for air gun, according to an embodiment.
Figure 2B:
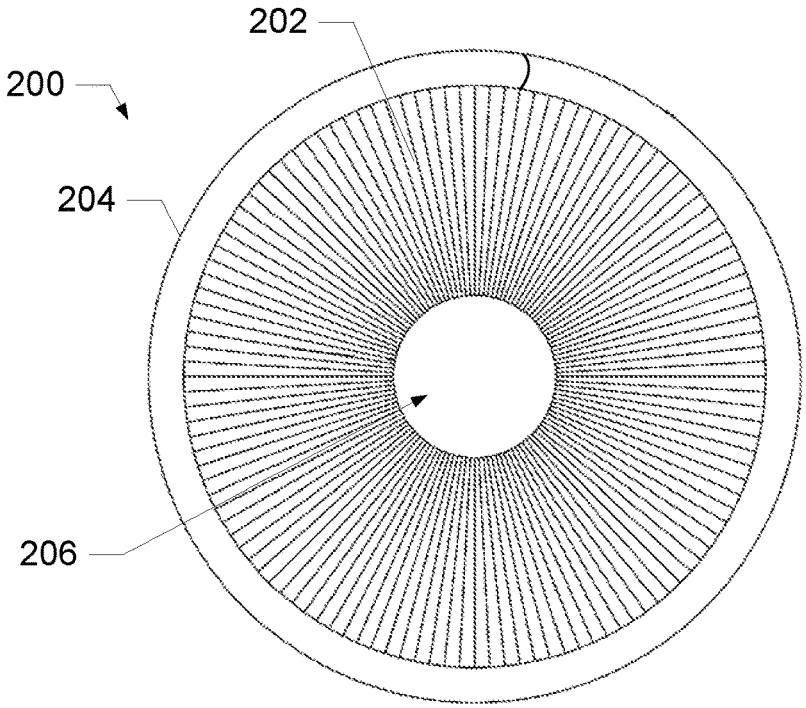

FIGS. 2A and 2B show example embodiments of a NRD 200 from a cross-sectional front-facing view. A set of filaments 202 is shown, which may be made from a flexible material such as Teflon or a similar material that gas/air can pass through with the filaments 202 offering some resistance to the gas/air penetration. The filaments 202 are attached to one or more rings 204, which may be individual ring-shaped units (as shown at FIG. 2A), or may be the coils of a spring or helix (as shown at FIG. 2B). When the rings 204 are individual units, the rings 204 may be coupled together by various means. For instance, the rings 204 may be coupled to the inside of a flexible tubular membrane, a plastic, composite or metal tube, and the like. The rings 204 may be formed of a plastic, a composite, a metal or alloy, a ceramic, natural or synthetic fibers, a combination of materials, and so forth. The rings 204 need not be circular, and can have an elliptical, polygonal, or other shape. Further, the band of the rings 204 may have an elliptical cross-section, a polygonal cross-section, a tear drop cross-section, a symmetrical cross-section, an irregular cross-section, or the like. The diameter of the rings 204 can be varying sizes, including 2 to 15 times the diameter of the projectile 104, and the width or thickness (at its largest dimension) of the rings 204 can vary also, including a several thousandths of an inch to over ½ inch.

The filaments 202 are coupled to the rings 204 in a radial arrangement, from the surface of the ring 204 inward. One end of a filament 202 is coupled to the ring 204 and the other end of the filament may be unattached near the center of the ring 204. Each filament 202 has a length that stops short of the center of the ring 204, which results in a hole or opening 206 at the center of the arrangement of filaments 202. The length of the filaments 202 and the resulting opening 206 where the filaments 202 converge can be selected for a desired caliber of projectile 104 or a range of projectiles 104. The length of the filaments 202 is such that the opening 206 has roughly the same circumference as the desired projectile 104. In some cases, the circumference of the opening 206 is slightly larger or smaller than that of the projectile 104.

The filaments 202 may be rod shaped, blade shaped, triangular, polygonal, elliptical, etc. in profile and in cross-section. The profile and cross-sectional shape of the filament may be selected for a desired noise reduction level and for performance/longevity of the NRD 200. The filaments 202 may be coupled to the ring 204 using adhesives, welding techniques, fasteners, or the like, or the filaments 202 may be formed to be integral to the ring 204. In other words, the filaments 202 may be formed in the same process as the rings 204 in some cases. The filaments 202 may be embedded into the material of the ring 204 or into holes in the material of the ring 204. The filaments 202 may be continuously distributed around the rings 204, or there may be spaces on the rings 204 or the helix of rings 204 without filaments 202.

The density (e.g., spacing) of the filaments 202 on the rings 204 can be selected for a desired noise reduction effect. For instance, fewer filaments 202 in a less-dense arrangement in the rings 204 can allow more air to pass through more quickly, which may result in a greater magnitude of shot noise. In contrast, more filaments 202 arranged in a more dense arrangement in the rings 204 can be more restrictive or cause more redirecting of the passing air, which may result in a lesser magnitude of shot noise. Tuning the amount of filaments 202 and the relative density of the filaments 202 on the ring(s) 204 tunes the desired noise magnitude for a particular application (which may have a particular air pressure and volume characteristic).

Figure 3A:
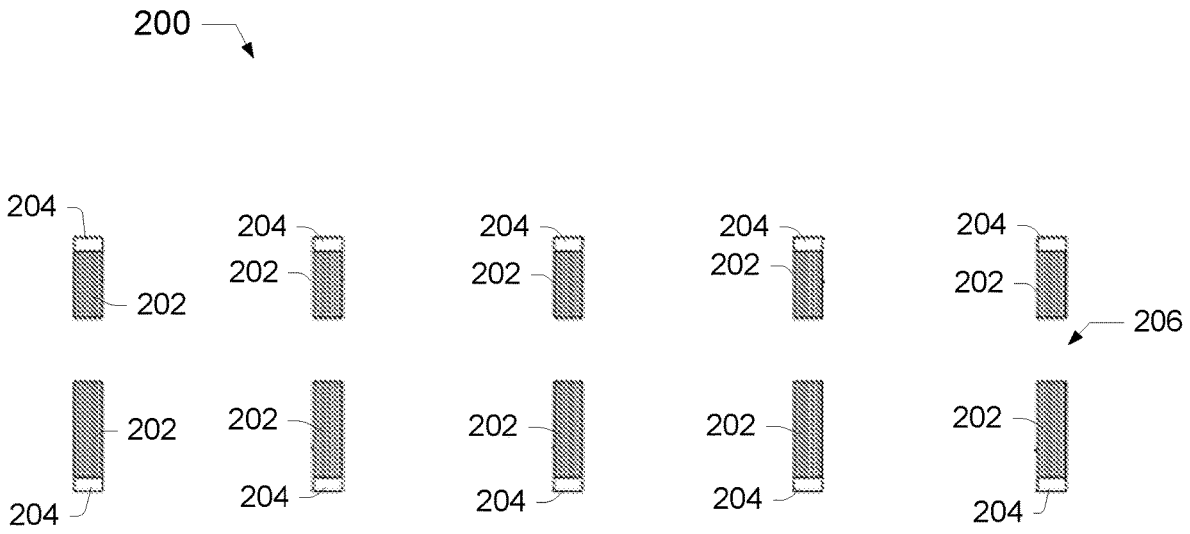
FIGS. 3A and 3B show a right side internal view of an example noise reduction device for air gun, according to one or more embodiments.
Figure 3B:
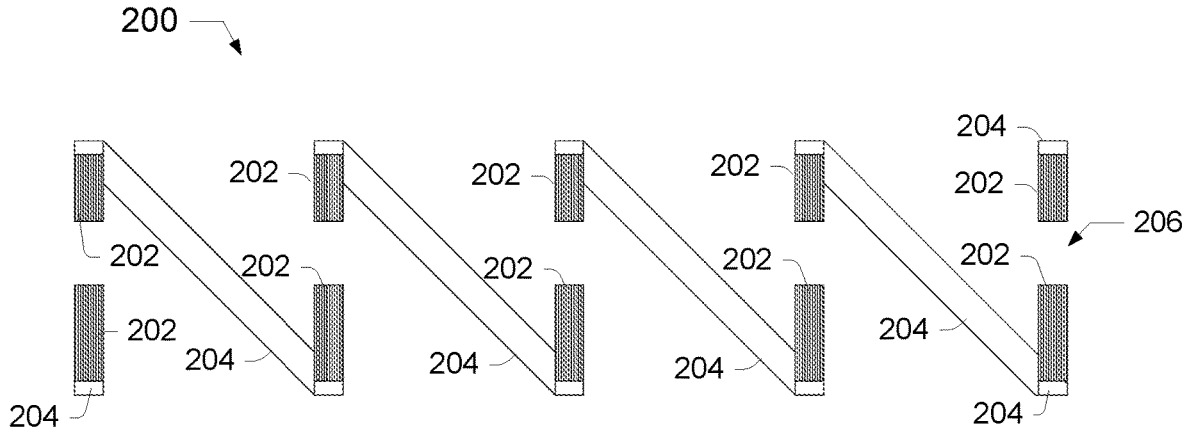

FIGS. 3A and 3B show the example embodiments of FIGS. 2A and 2B respectively, from a cross-sectional right-side view. In the examples, the filaments 202 are attached to an inside surface of the rings 204, which are separate rings 204 in FIG. 3A and are arranged in the form of a spring coil, helix, or helix-like arrangement in FIG. 3B. In alternate embodiments, the filaments 202 may be coupled to a side surface of the coils or rings 204, or embedded into or integral to the rings 204. The coils or rings 204 are arranged at a given spacing suitable to control gas/air flow. The spacing of the coils or rings 204 may be selected for particular applications, for instance based on the air pressure of the air gun reservoir 106. In some examples, the rings 204 can be spaced approximately ¼ inch to over 1 inch apart. Moving the rings 204 closer together can offer greater resistance or more redirection to the air flow through the NRD 200. Further, increasing the number of rings 204 in the sequence also offers greater resistance or more redirection to the air flow through the NRD 200. While 5 rings 204 or coils are shown in the attached figures, it is not intended to be limiting. The NRD 200 can have any number of rings 204 or coils desired.

Referring to FIG. 3B, the helix arrangement of the rings 204 may act like a spring, with the rings 204 moving (being pushed) with the force of the air moving through them, and causing a dampening on the air flow due to the movement of the rings 204. The movement of the rings 204 and the resulting dampening may occur based on a spring constant of the spring or helix arrangement of the rings 204. For example, as the pressurized gas 102 moves through the filaments 202, the gas pushes on the filaments 202 and the spring nature of the helix arrangement causes the rings 204 to move, which uses up some of the energy of the moving air. The resistance of the filaments 202 to the moving air also removes energy from the moving gas 102.

While a helix arrangement is illustrated generally, this is not intended to be limiting. Other arrangements and means of coupling the rings 204 together are also contemplated and within the scope of the disclosure. Some other means also allow a degree of movement from passing air by the rings 204 with respect to each other and/or the NRD 200 to provide dampening action.

Figure 4:
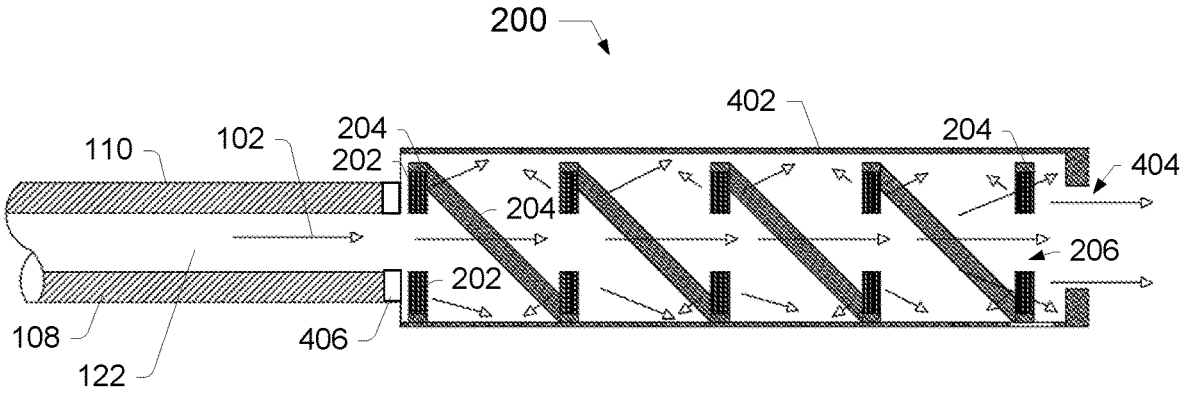
FIG. 4 shows a right side view of an example noise reduction device for air gun, according to one or more embodiments.

The illustration at FIG. 4 shows a right-side cut-away view of an embodiment of an NRD 200, potentially for smaller caliber air guns 100 that do not require controlling the larger gas/air volumes associated with larger caliber gas/air rifles 100. The NRD 200 is fixed to the air gun barrel 110 or is formed integral with the barrel 110 as discussed above. For example, the NRD 200 may be coupled to the barrel 110 via a coupler 406, such as a threaded section, a twist-fit coupling, a friction-fit coupling, a bayonet-type coupling, a clamp coupler, an interlocking coupler, a quick-disconnect coupler, a compression coupler, a snap coupler, a toothed coupler, a welded section, or any other type of coupler for joining pipes or tubes. In an alternative, the NRD 200 may be formed as part of the barrel 110. The NRD 200 may have a single outer tube 402 surrounding the rings 204 and the filaments 202, which may be arranged as shown at either FIG. 3A or 3B. (While the arrangement of FIG. 3B is illustrated, it is not intended to be limiting.) The tube 402 can have various diameters and lengths, based on the application (e.g., caliber, gas pressure, potential energy, etc.) and on the desired noise reducing performance. In general, the larger the diameter of the tube 402, the shorter the length of tube 402 can be for substantially equal performance, and vice versa (the smaller the diameter of the tube 402, the longer the length of the tube 402 for substantially equal performance). In various examples, the tube 402 can have a diameter ranging from less than 1 inch to over 10 inches. The length of the tube 402 can be less than 4 inches to over 24 inches.

The operation of this NRD 200 is as follows. The gas/air flow enters the NRD 200 from the barrel 110 and contacts the filaments 202. As the filaments 202 are moved by the high-pressure air 102, they use up some energy from the gas/air movement and offer resistance and redirection to the gas/air movement. As the gas/air 102 moves between the spaced rings 204 of filaments 202, the rings 204 may also move in reaction to the gas/air force, dissipating more energy from the gas/air movements. All reduced and redirected gas/air is vented out of the NRD muzzle 404.

Figure 5:
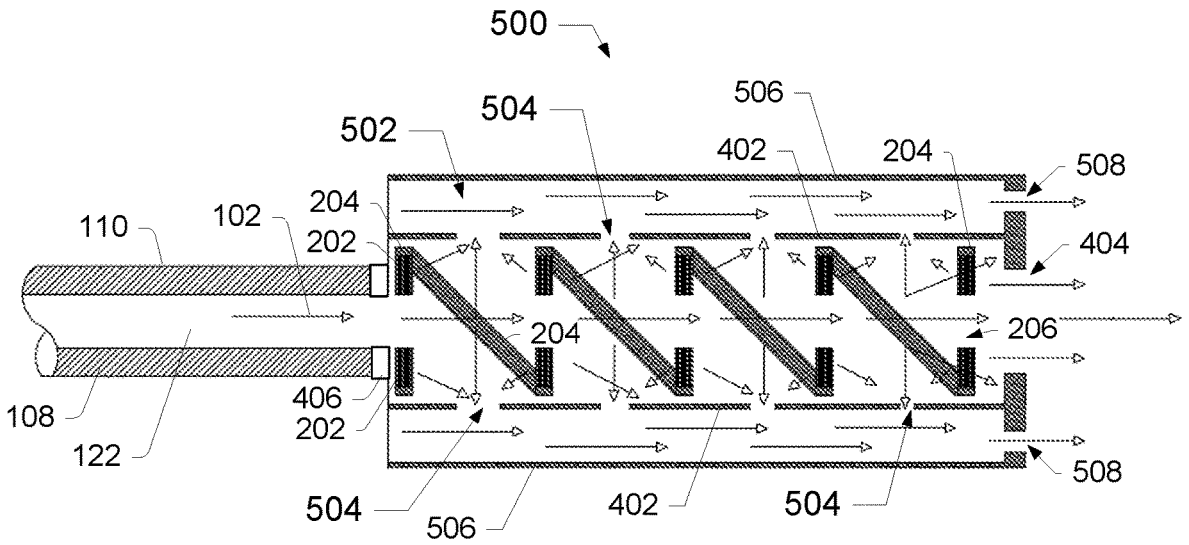
FIG. 5 shows a right side view of an example noise reduction device for air gun, according to one or more embodiments.

FIG. 5 shows an example embodiment of a NRD 500 from a cross-sectional right-side view. The NRD 500 is similar to the NRD 200 in construction and operation, but includes a pressure stabilization region 502 in addition to the features disclosed prior. The example NRD 500 illustrated at FIG. 5 can be applicable for various calibers of air guns 100, and particularly for larger calibers of air guns 100 that require the control of larger gas/air 102 volumes. As shown in the illustration, the NRD 500 is coupled to an air gun barrel 110. Alternately, the NRD 500 may be formed integral to the barrel 110.

As shown in the illustration: a tube 402 surrounds the rings 204, which may be arranged separately or in a helix as described above. In an embodiment, the tube 402 includes a series of air holes 504 through the tube 402. In some cases, the air holes 504 may decrease in size, from the barrel 110 towards the muzzle 404 or opening of the device 500. In other cases, the air holes 504 may be substantially the same size, or may vary in size according to a different pattern or a random arrangement. An outer tube 506 surrounds the inner tube 402, while leaving an air chamber 502 between the inner tube 402 and the outer tube 506. The muzzle end 404 of the outer tube 506 can include one or more air holes 508 that may be evenly-spaced at the muzzle end 404 of the NRD 500.

The operation of this NRD 500 is as follows. The gas/air 102 flow enters the NRD 500 from the barrel 110 and contacts the filaments 202. As the filaments 202 are moved by the high-pressure air 102, they use up some energy from the gas/air movement and offer resistance and redirection to the gas/air movement. As the gas/air 102 moves between the spaced rings 204 of filaments 202, the rings 204 may also move in reaction to the gas/air force, dissipating more energy from the gas/air movements.

As the gas 102 enters the space between the filaments 202 it encounters resistance from the filament 202 material and some gas/air 102 is pushed at a right angle through a hole 504 in the inner tube 402, which may initially be a larger hole 504 near the barrel 110. The gas 102 that moves through the holes 504 in the inner tube 402 moves into the space 502 between the inner tube 402 and the outer tube 506. As the space 502 between the inner tube 402 and the outer tube 506 fills with the gas/air 102, this interaction causes a resistance to the gas movement offering more energy reduction and a pressure stabilization before the gas/air 102 exits out of the air holes 508 at the muzzle opening 404 at the front of the NRD 500 and into the atmosphere.

Figure 6:
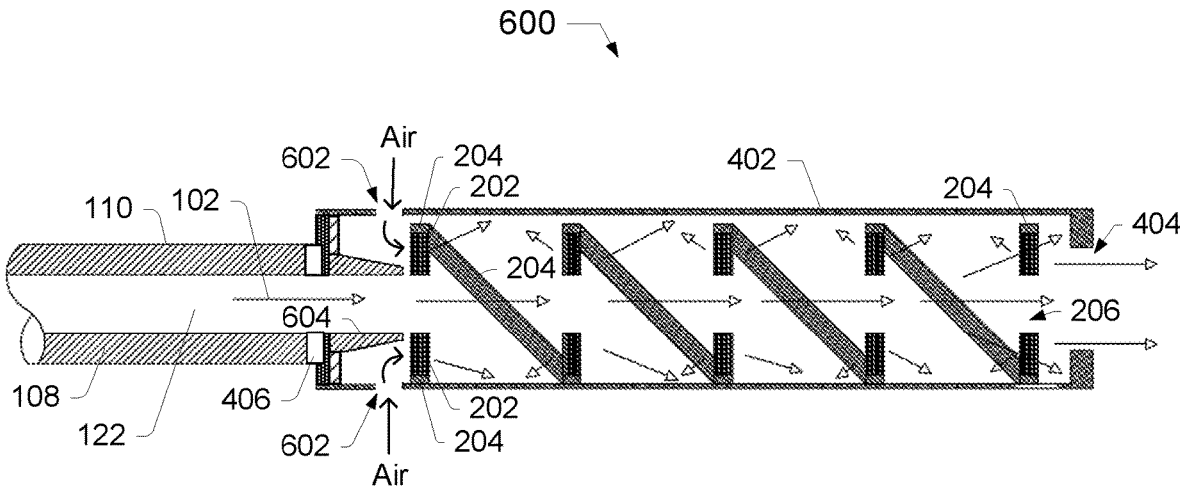
FIG. 6 shows a right side view of an example noise reduction device for air gun, according to one or more embodiments.

FIG. 6 shows an example embodiment of a NRD 600 from a cross-sectional right-side view. The NRD 600 is similar to the NRD 200 in construction and operation, but includes one or more air injection holes 602 in addition to the features disclosed prior. The example NRD 600 illustrated at FIG. 6 can be applicable for various calibers of air guns 100. As shown in the illustration, the NRD 600 is coupled to an air gun barrel 110. Alternately, the NRD 600 may be formed integral to the barrel 110.

As shown in the illustration: a tube 402 surrounds the rings 204, which may be arranged separately or in a helix as described above. In an embodiment, the tube 402 includes one or more air injection holes 602 through the tube 402. In some cases, the air injection holes 602 are arranged to be substantially 90 degrees to the bore 122 of the barrel 110. In other cases, the air injection holes 602 may be disposed at different angles to the bore 122.

In an implementation, a truncated cone 604 is disposed at the barrel 110 end of the NRD 600. The truncated cone 604 has a hollow center that allows the pressurized gases 102 to pass from the barrel bore 122 through to the interior of the NRD 600. The truncated cone 604 also has a substantially conical outer surface that directs the incoming air from the environment through the air injection holes 602 and into and through the filaments 202.

The operation of this NRD 600 is as follows. The gas/air 102 flow enters the NRD 600 from the barrel 110 and contacts the filaments 202. As the filaments 202 are moved by the high-pressure air 102, they use up some energy from the gas/air movement and offer resistance and redirection to the gas/air movement. The passage of gas/air 102 past the air injection holes 602 creates a vacuum that pulls air from the environment into and through the air injection holes 602. The conical surface of the truncated cone 604 directs the incoming environmental air through the filaments 202 with the pressurized gas/air 102. As the gas/air 102 and the environmental air moves between the filaments 202 and spaced rings 204, the rings 204 may also move in reaction to the gas/air force, dissipating more energy from the gas/air movements. The gas/air 102 exits out of the muzzle opening 404 at the front of the NRD 600 and into the atmosphere.

In some embodiments, the use of air injection through the air injection holes 602 allows the NRD 600 to reach full noise reduction effectiveness without being initially pressurized. In the embodiments, the addition of air injection to the NRD 600 can reduce the noise of the shot report by up to 20 dB.

Note that when the disclosed embodiments are formed of plastics, and other light materials, the NRD 200, 500, 600 may not work on firearms because of the high temperatures and pressures of firearms. The high pressures and temperatures would destroy the NRD 200, 500, 600 device and be unsafe for use. The traditional role of a silencer for a firearm is to capture and hold rigidly the expanding gases, until gases have been kept from expanding or have cooled to reduce the expansive nature of this type of gas. Given the nature of this type of exponentially expanding gases used in firearms, to trap and hold the gases is by nature impossible without huge confinement areas contained within the device. This is made even harder as oxygen is available to accelerate the gas burn when the unburnt propellant (gun powder) contacts oxygen. Strictly speaking, "silencing" devices for firearms are not safe to use. Touching them cause's burns. They must be cleaned regularly. The silencer device's effectiveness diminishes with use.

In contrast, the NRD 200, 500, 600 for an air gun 100 has the following advantages: The nature of the gas 102 used to propel the projectile 104 diminishes the instant the air gun's compressed gas 102 is released into the barrel 110. (The term fired is not applicable as no combustion is present). As the projectile 104 is pushed down the barrel 110, gas pressure will not increase as the residual gas 102 passes out of the barrel 110. An NRD 200, 500, 600 for an air gun 100 merely needs to redirect the gas's energy by directing its movement around corners and items to be moved, thus slowing the gas movement below the speed of sound. The disclosed NRD 200, 500, 600 will not diminish capacity or capability with use. The disclosed NRD 200, 500, 600 operates cold by nature.

By way of comparison, a NRD 200, 500, 600 for an air gun 100 need not be compatible with the high heat and pressure of a firearm, including: burning materials, high temperature gases—up to thousands of degrees, unburnt debris, high pressure generation within the device, temperature and pressure is increased as the gasses exit the barrel and additional oxygen is introduced, erratic pressure zones inside the device, diminishing effectiveness as debris builds between shots, heat transfer to the atmosphere, and a limited life span—including from gas cutting and erosion. As a result, unlike a silencer for a firearm, a NRD 200, 500, 600 need not be comprised of: rigid construction to handle high pressures and pressure spikes, often exotic materials like inguinal and seminal materials for high heat, welded or fixed-permanent attachment between components, and sealed designs.

Notwithstanding the foregoing, a NRD 200, 500, 600 may be constructed that is acceptable for use in conventional firearms, by using materials that satisfy the demands of firearm use. For instance, the filaments 202 may be comprised of a material that can withstand the high-temperatures and high-pressures of a conventional firearm, such as brass, stainless steel, copper, or other metals or alloys. Further, the inner tube 402 may be comprised of titanium, or other high-temperature metals or alloys, or polymer blends or composites intended for use with the high-temperatures and high-pressures of a conventional firearm. The outer tube 506 may be comprised of carbon fiber, aluminum, other metals or alloys, graphite or carbon blends or composites.

By way of summary, and without limiting the details, a NRD 200, 500, 600 may be manufactured for use by using materials that are suitable for high-temperatures and high-pressures rather than materials suitable for low-temperatures and low-pressures as described above.

Although various implementations and examples are discussed herein, further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. An apparatus, comprising:

a plurality of rings, a center of each ring of the plurality of rings being collinear, wherein each ring of the plurality of rings includes a plurality of flexible filaments fixed radially to the ring toward the center of the respective ring such that the filaments of the plurality of flexible filaments are arranged to move in response to a gas passing through the filaments, a length of each filament being a fraction of a radius of the ring such that the plurality of filaments defines an opening at the center of the respective ring; and a coupler for coupling the plurality of rings to a muzzle end of a barrel of a gun.

2. The apparatus of claim 1, further comprising a first tube surrounding the plurality of rings, the first tube including the coupler at a first end of the first tube and a muzzle opening at an opposite end of the first tube corresponding in size and location to the opening at the center of the plurality of rings.

3. The apparatus of claim 2, wherein the first tube includes one or more air injection holes through the first tube.

4. The apparatus of claim 3, further comprising a truncated cone disposed within the first tube at a location corresponding to the one or more air injection holes, the truncated cone having a hollow center aligned collinear to the center of each ring of the plurality of rings.

5. The apparatus of claim 2, further comprising an outer tube surrounding the first tube such that a space is formed between an outer surface of the first tube and an inner surface of the outer tube.

6. The apparatus of claim 5, wherein the outer tube includes one or more air holes at a muzzle end of the outer tube that are arranged to vent air from the space between the first tube and the outer tube into the environment.

7. The apparatus of claim 5, wherein the first tube includes one or more air holes through the first tube arranged to allow air to pass into the space between the first tube and the outer tube.

8. The apparatus of claim 7, wherein the one or more air holes comprise a series of air holes that decrease in size from the barrel end of the first tube to the muzzle end of the first tube.

9. The apparatus of claim 1, wherein a spacing of the filaments and a spacing of the rings determines a noise reduction capability of the apparatus.

10. The apparatus of claim 1, wherein the rings comprise portions of a helix.

11. A noise reduction apparatus, comprising:

a plurality of connected rings arranged in a helix comprising a spring, a center of each ring of the plurality of rings being collinear, and each ring comprising a coil of the helix, wherein each ring of the plurality of rings includes a plurality of filaments fixed radially to the ring toward the center of the respective ring, a length of each filament being a fraction of a radius of the ring such that the plurality of filaments defines an opening at the center of the respective ring; and a first tube surrounding the plurality of rings such that the rings of the plurality of rings are free to move in a spring motion within the first tube, the first tube including a coupler at a first end of the first tube and a muzzle opening at an opposite end of the first tube corresponding in location to the opening at the center of the plurality of rings, the coupler configured to couple the first tube and the plurality of rings to a muzzle end of a barrel of a gun.

12. The noise reduction apparatus of claim 11, wherein the first tube includes one or more air injection holes through the first tube.

13. The noise reduction apparatus of claim 11, further comprising a truncated cone disposed within the first tube with a base of the truncated cone at the first end of the first tube, the truncated cone having a hollow center aligned collinear to the center of each ring of the plurality of rings.

14. The noise reduction apparatus of claim 11, further comprising an outer tube surrounding the first tube such that an air space is formed between an outer surface of the first tube and an inner surface of the outer tube.

15. The noise reduction apparatus of claim 14, wherein the outer tube includes one or more air holes at a muzzle end of the outer tube that vents air from the air space between the first tube and the outer tube into the environment.

16. The noise reduction apparatus of claim 14, wherein the first tube includes one or more air holes through the first tube arranged to allow air to pass into the air space between the first tube and the outer tube.

17. The noise reduction apparatus of claim 11, wherein a quantity of the filaments, a spacing of the rings, and a spring constant of the helix determines a noise reduction capability of the apparatus.

18. A noise reduction apparatus, comprising:

a plurality of rings, a center of each ring of the plurality of rings being collinear, wherein each ring of the plurality of rings includes a plurality of filaments fixed radially to the ring toward the center of the respective ring, a length of each filament being a fraction of a radius of the ring such that the plurality of filaments defines an opening at the center of the respective ring; and a first tube surrounding the plurality of rings such that the rings of the plurality of rings are free to move within the first tube, the first tube including a coupler at a first end of the first tube and a muzzle opening at an opposite end of the first tube corresponding in location to the opening at the center of the plurality of rings, the coupler configured to couple the first tube and the plurality of rings to a muzzle end of a barrel of a gun.

19. The apparatus of claim 18, wherein the coupler is configured to couple the first tube and the plurality of rings to a muzzle end of a barrel of an air gun.

* * * * *